United States Patent [19]

Hawkins

[11] 4,005,566

[45] Feb. 1, 1977

[54] PROCESS AND APPARATUS FOR IMPORTING COHERENCE TO TOW

[75] Inventor: William Edward Hawkins, Circleville, Ohio

[73] Assignee: E. I. Du Pont de Nemours and Company, Wilmington, Del.

[22] Filed: Mar. 3, 1969

[21] Appl. No.: 814,492

Related U.S. Application Data

[63] Continuation-in-part of Ser. No. 749,245, July 16, 1968, abandoned, which is a continuation of Ser. No. 669,634, Aug. 9, 1967, abandoned, which is a continuation-in-part of Ser. No. 524,750, Feb. 3, 1966, abandoned.

[52] U.S. Cl. ..... 57/34 B; 28/1.4; 28/21; 28/72.12; 57/157 F

[51] Int. Cl.[2] ..... D02J 1/04; D02J 1/08

[58] Field of Search ..... 28/1.4, 72.12, 21, 72 R, 28/1 CF; 57/34 B, 157 F, 157 R

[56] References Cited

UNITED STATES PATENTS

| | | | |
|---|---|---|---|
| 2,805,765 | 9/1957 | Saum et al. | 28/21 UX |
| 2,859,506 | 11/1958 | Slayter | 57/34 B |
| 3,081,951 | 3/1963 | Dyer et al. | 28/1.4 X |
| 3,095,343 | 6/1963 | Berger | 28/1.4 X |
| 3,099,594 | 7/1963 | Caines et al. | 28/1.4 X |
| 3,110,151 | 11/1963 | Bunting, Jr. et al. | 57/157 F |
| 3,116,588 | 1/1964 | Breen et al. | 57/157 F |
| 3,116,589 | 1/1964 | Edwards et al. | 57/157 F |
| 3,262,181 | 7/1966 | Hawkins et al. | 28/1.4 X |
| 3,296,785 | 1/1967 | Hardy | 57/34 B |

*Primary Examiner*—John Petrakes

[57] ABSTRACT

Process and apparatus for increasing the coherency of a filamentary tow by passing a tow through a turbulent fluid zone exerting a braking and vortical action on the filaments, and withdrawing the tow. Apparatus for forming the turbulent zone comprises fluid streams directed into a funnel-shaped treating chamber so that a major portion of the spent fluid discharges in a direction opposite to the tow motion. Tow delivery apparatus for delivering the tow to the treatment preferably includes a jet device for opening and forwarding the tow.

16 Claims, 5 Drawing Figures

INVENTOR
WILLIAM E. HAWKINS

BY Morris E. Reckman
ATTORNEY

INVENTOR
WILLIAM E. HAWKINS

BY Norris E. Ruckman
ATTORNEY

INVENTOR
WILLIAM E. HAWKINS

BY Norris E. Ruckman
ATTORNEY

PROCESS AND APPARATUS FOR IMPORTING COHERENCE TO TOW

CROSS-REFERENCES TO RELATED APPLICATIONS

This is a continuation-in-part of my application Ser. No. 749,245, filed July 16, 1968, as a continuation of my application Ser. No. 669,634, filed Aug. 9, 1967, as a continuation-in-part of my application Ser. No. 524,750, filed Feb. 3, 1966, said prior applications now being abandoned.

FIELD OF THE INVENTION

This invention relates to the handling of large ropes or tows in the manufacture of textile fibers or non-woven fibrous structures. In particular, it deals with process and apparatus for treating of multifilamentary tows soon after their formation, e.g., soon after extrusion and solidification of molten polymer to melt spin filaments of synthetic linear polymer, in order to facilitate subsequent processing of such tows.

Difficulties are encountered in the continuous processing of large twistless tows (i.e., greater than 50,000 denier) of continuous filament at speeds of 1,000 feet per minute or more. Even with a moderate amount of twist, such tows tend to split apart or fold at the edges. Filaments or groups of filaments stray from the main bundle and become snarled or broken. Such splitting and separation causes interference with continuous processing into desirable products, resulting in interruptions in operation and in non-uniformities in the product.

The objective of this invention is to provide improvements in method and apparatus for treating moving filamentary tows. The primary purpose is to provide an economical method of imparting coherence to twistless multifilament tows so that they can be handled more efficiently at high speeds. Another object is to provide a treating process which, in itself, is capable of high speed and can be readily combined with other tow treating processes. Other objects of the invention will also become apparent from the subsequent disclosure and claims.

SUMMARY OF THE INVENTION

In accordance with the present invention a plurality of filaments are gathered together into a bundle, the filament bundle is forwarded through a funnel guide into which a current of compressed air or other fluid is blown to maintain the bundle open and cause the filaments to become interentangled, the said current of compressed air having its major component of motion in a direction of motion opposite to that of the movement of the filament bundle to exert a braking action and the bundle is withdrawn to provide a tow having good interfilament cohesion.

A bundle of continuous filaments is forwarded to the treatment by feed rolls or other tow delivery apparatus. In accordance with a preferred embodiment, the tow delivery apparatus includes a puller jet device in which the filament bundle is simultaneously forwarded away from the feed rolls and opened; the bundle is next passed through a confining zone, and then through the funnel guide and a belt piddler. The confining zone may be a simple plate or an encircling guide placed transversely with respect to the path of the tow, with an aperture of sufficient size to permit passage of the tow.

The process achieves a coherence of the multifilamentary tow by interlacing the filaments constituting the bundle. A preferred embodiment of the apparatus is described below.

BRIEF DESCRIPTION OF THE DRAWINGS

A better understanding of the invention may be had by referring to the figures and discussion which follow.

DESCRIPTION OF THE PREFERRED EMBODIMENT

Figure 1:
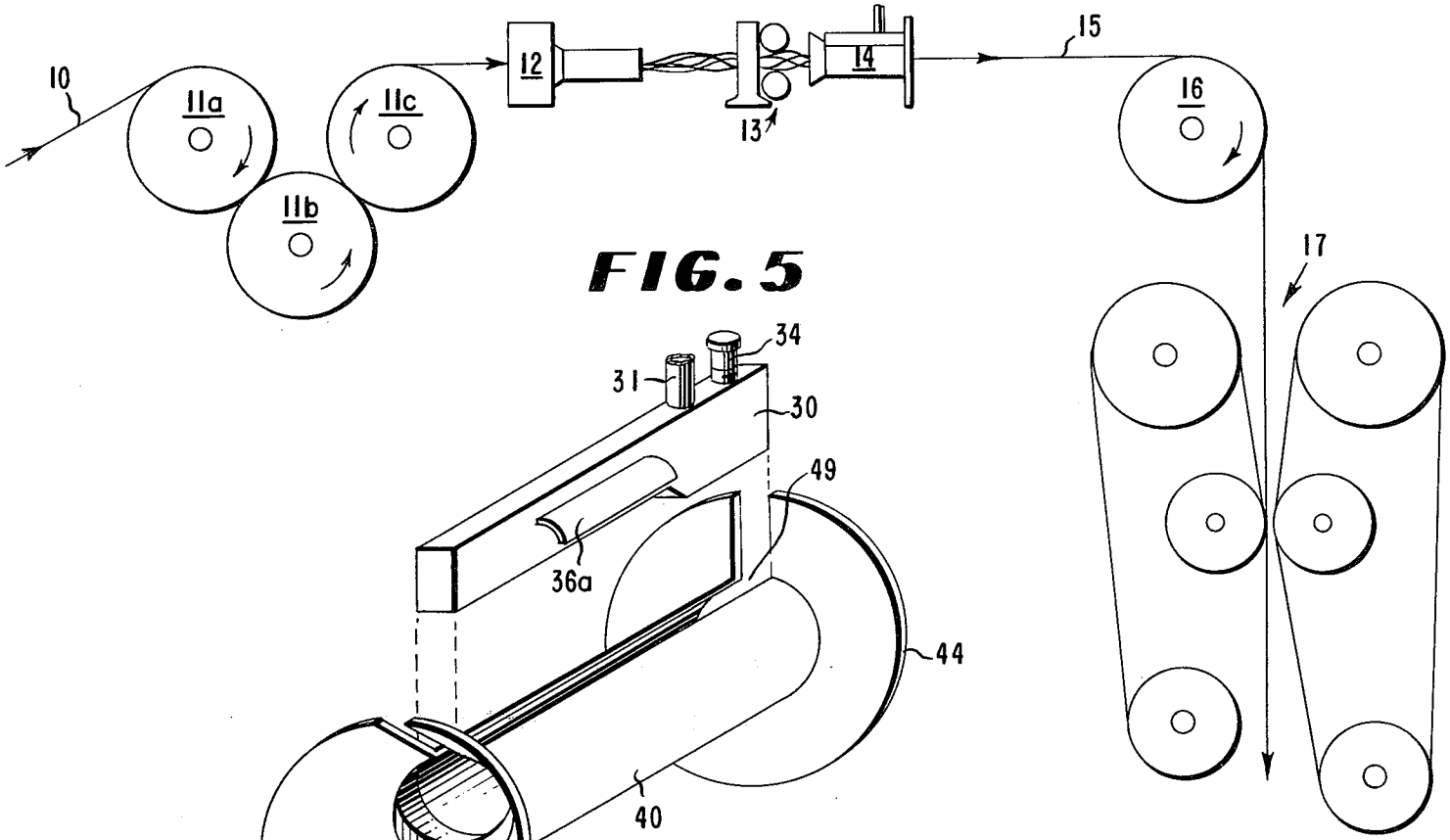
FIG. 1 illustrates schematically the general assembly of one embodiment of apparatus of the invention.

FIG. 1 illustrates the apparatus of this invention during operation of the process. A tow of continuous multifilaments 10 is advanced from the left to the interlacing apparatus at a predetermined speed by co-acting driven feeding rolls, 11*a*, 11*b* and 11*c*. The tow is pulled from the feeding rolls by a first fluid jet device 12, is passed through an opening in an array of roller guides 13 and is conveyed into a second fluid jet device 14. These devices are aligned so as to provide an essentially straight path for movement of the tow. The treated tow 15 passes around an idler roll 16 and is drawn away from interlacing apparatus by a belt piddler 17, disclosed in more detail in U.S. Pat. No. 3,254,820. Other suitable tow delivery apparatus may also be used.

Figure 2:
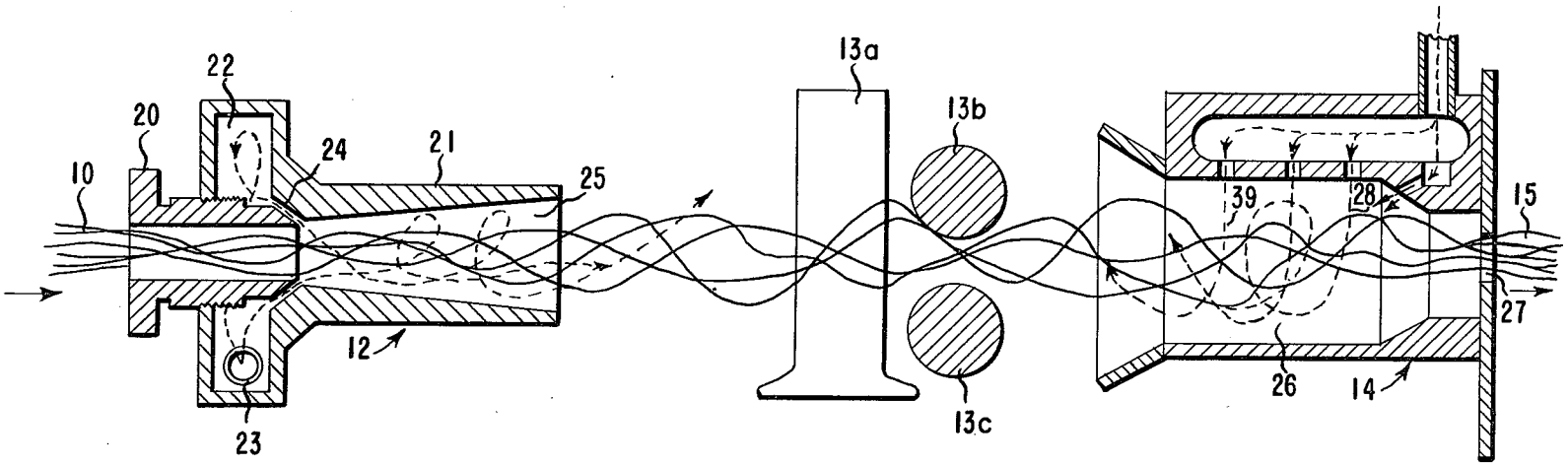
FIG. 2 illustrates in elevational cross-section the internal regions of the apparatus and the functioning of the process. The cross section is taken along the central axis of the tow passageways.

Details of the apparatus and process are illustrated in FIG. 2, in which a longitudinal sectional view of the puller jet 12, the roller guides 13*a*, 13*b*, 13*c*, and the interlacing jet 14 are shown. A preferred puller jet 12 comprises a central tubular nozzle 20 threadedly engaged in body member 21. Body member 21 is provided with an annular fluid chamber 22 surrounding the nozzle 20, a pipe 23 for supplying fluid under pressure near the periphery and tangentially to the annular passage, a conical converging throat 24 surrounding the end of the nozzle 20, and an adjoining diverging conical section 25. The arrangement of the fluid pipe 23 and annular chamber 22 cause the fluid supplied to the chamber to assume a rotary motion in a plane generally perpendicular to the path of the tow 10. The fluid takes a spiraling path around the tow as it flows from the chamber 22 through the space between the nozzle 20 and throat 24 and into the venturi-like passage formed by diverging section 25. Compressed air is the most economical and convenient fluid, although other gases or vapors may be used if desired. Additional fluid supply pipes may be positioned around annular chamber 22 if more vigorous flow is desired. The internal axial passage of the device must be of sufficient transverse area to permit free movement of the tow to be processed. The puller jet serves two functions; to exert tension on the tow to provide constant takeup from the feeding rolls and to provide a separating action on the filaments and open the tow bundle.

The moving tow next passes through a guide arrangement which, in the apparatus illustrated, comprises four rollers arranged so as to form a rectangular opening. The guide arrangement serves to confine lateral motion and dampen erratic oscillations of the tow, and to prevent interference due to fluid discharge from the jets. Ceramic or metal guides commonly used in the textile industry may be substituted for the rollers. A simple flat baffle plate with a suitable aperture for the tow will also serve the purpose. The use of rollers, however, reduces the frictional drag on the moving bundle of filaments.

The opened tow bundle enters the second jet 14 in which it is subjected to a plurality of fluid streams in treating chamber 26. The treated tow 15 exits through restriction 27 to a suitable takeup or subsequent processing. In the treating chamber, one group of fluid streams 28 is directed so as to impinge upon the advancing tow at an angle and in a direction opposite to the direction of movement of the tow, tending to brake the tow travel. At the same time, other fluid streams 39 flow into the chamber in a generally tangential direction to the tow path so as to impart a vortical whirling motion. The major portion of the spent fluid discharges in a direction opposite to the tow motion, tending to buffet and separate the advancing filaments. The rotational direction of flow of the fluid about the axis of the tow may be either clockwise or counterclockwise. Preferably, the rotational direction of the fluid is the same in both jet 12 and jet 14.

The action of the process, as it is understood by observation, is illustrated in FIG. 2. The filaments of the advancing tow are shown in solid lines and the paths of fluid flow are shown by dotted lines. While a discrete length of tow is within the bounds of the jets 12 and 14, the opposing axial components of the fluid streams impart a slackened condition to this section of the tow. This slackness permits the filaments of the untreated tow 10 passing through jet 12 to be separated by the fluid. The vigorous fluid action within jet 14 imparts a whirling action to the loose open tensionless structure of the tow, causing the filaments to become interentangled. As the treated tow moves out of jet 14 and becomes tensioned again, it resumes an essentially straight configuration but is more coherent because of the interfilamentary entanglement. The required spacing between the jets is not particularly critical. If the separation is too great, however, the weight of the tow catenary causes tension which prevents the interlacing action. The jets 12 and 14 are preferably fairly close to each other to facilitate the process and to make the assembly compact, but are not so close as to interfere with the action of each other. The guide arrangement 13, as previously stated, serves as a barrier to interference of the fluid streams, issuing from closely positioned opposed jets, and also confines any erratic undulating action of the free section of the tow under treatment.

Figure 5:
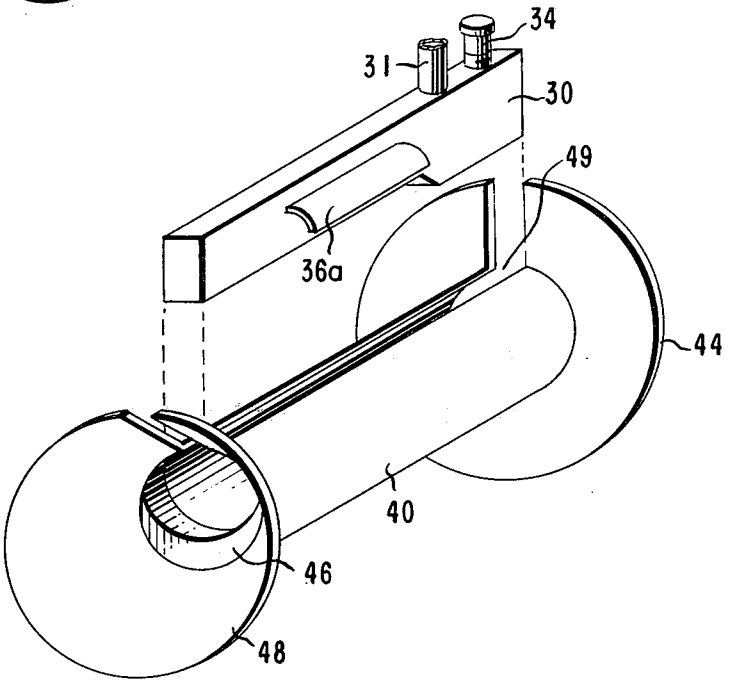
FIG. 5 is a perspective view of the jet of FIG. 3, showing the principal parts in a separated position.
Figure 3:
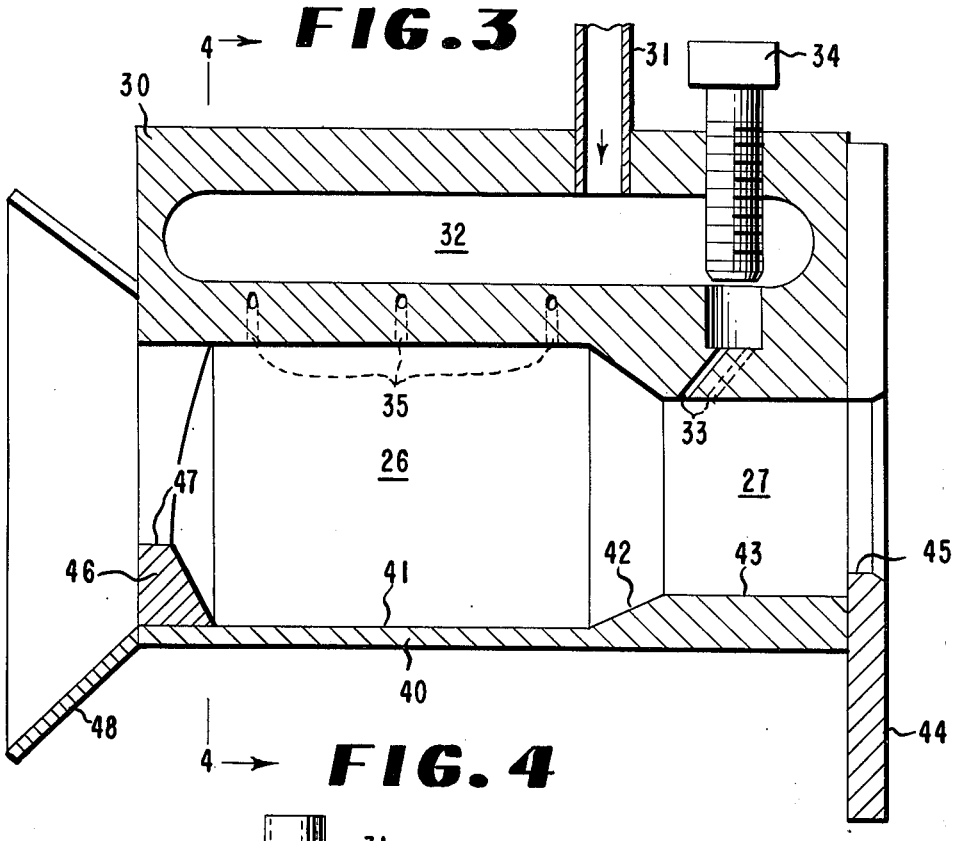
FIG. 3 is a longitudinal sectional view of an embodiment of jet device for use in the assembly to brake and interentangle the filaments of the moving tow, the section being taken as in FIG. 2.
Figure 4:
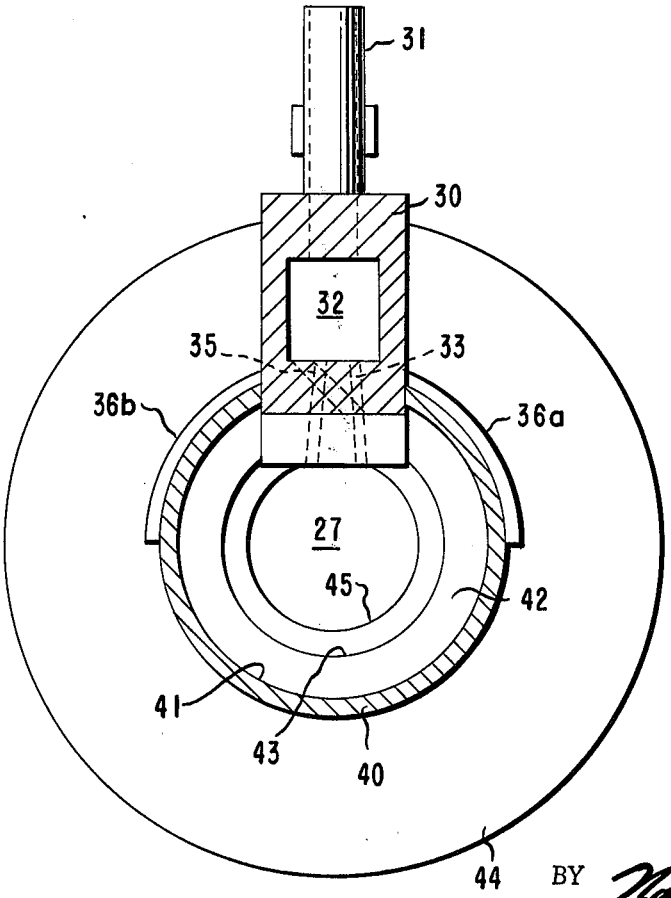
FIG. 4 is a transverse section of the jet of FIG. 3, taken on the line 4—4.

A preferred embodiment of jet device 14 is shown in FIGS. 3 and 4. This device consists of two principal parts: a body member 30 and a tubular shell 40. The body member 30 contains a cavity 32 for internal distribution of the treating fluid, which is supplied through conduit 31 from a source not shown. One or more ducts 33 leads from the cavity at an angle, preferably less than 60° with respect to the longitudinal axis, through the wall of the exit passage 27 toward the common central axis of the exit and treating chamber 26. A threaded plug 34 provides means for adjusting the rate of flow of the fluid to ducts 33 as desired. Other fluid ducts 35 lead from the fluid cavity 32 into treating chamber 26 in a plane perpendicular to the central axis of the chamber 26 and directed to a point between the central axis of the yarn passage and its peripheral wall 41. The second fluid zone is generated in tubular shell 40. Shell 40 is a cylindrical member with an exit bore 43 confining the exit passage 27 diverging in a tapered section 42 to an enlarged bore 41 confining the treating chamber 26. Exit passage 27 must be of sufficient size to permit free movement of the treated tow through it. Apertures ranging in diameter from ½ to 1½ inches are suitable for tows ranging from 50,000 to 500,000 total denier, the larger sizes being required for the larger tows. The transverse area of the treating chamber 26 should be at least 50 percent greater than exit passage 27 to permit the fluid turbulence to interweave the filaments among each other. Flange member 44 is attached to the end of shell 40 for longitudinal positioning of the tube with respect to the body 30. The bore 45 of the end flange 44 may provide the desired exit restriction. An insert 46 with bore 47 may be desirable to center the tow bundle in the passage at the entry and to contain the fluid turbulence for greater interlacing effectiveness. The entry of tow into the treatment area may be facilitated by a convergent funnel-shaped member 48 which presents a smooth surface to the advancing tow and reduces snagging or drag on the filaments. Alternatively a flat baffle or shield similar to baffle 44 at the opposite end may be used. Shell 40, exit flange 44, insert 46 and entry member 48 are fixably attached to each other to form a unitary member. A longitudinal slot shown at 49 in FIG. 5 is cut through the wall of this unitary member to receive body member 30; flange members **36*a* and 36*b* rest against tubular shell 40** in the assembled operating position. A clamp or locking arrangement, not shown, is employed to hold the body member against the tubular shell during operation of the process.

In order to commence operation of the process, the leading end of a tow 10, to be treated, is led by a sucker gun from the feed rolls 11 and introduced into the puller jet 12. The tow is then picked up again from the discharge of the puller jet 12 and led through the roller guides 13, through the tubular shell 40 of interlacer jet 14 through its slot, over idler roll 16 and released into belt piddler 17. The speeds of feed rolls 11 and belt piddler 17 are synchronized so that the tow is under essentially zero tension before air is supplied to the jet devices. Movable body member 30 of the interlacing jet 14 is slipped into the slot of the tubular member 40 and is fastened in place against the fixed tube 40. The air is then turned on and interlacing commences.

The invention has been found to be effective over a wide range of tow sizes and operating speeds. For example, it has been possible to process approximately 135,000 denier nylon tow of 8 denier per filament at speeds in excess of 2000 ft./min. Using jets of the type shown in FIG. 2, puller jet 12 exerted a pull of 2–3 lbs. force on the untreated tow 10 with air at 45 psig. and interlacing jet 14 operating with 80 psig. air exerted a braking force of 1 to 1½ lbs. on the treated tow 15. The tow treated under these processes conditions was well interlaced and coherent, being essentially free of loopiness or separation of the filamentary bundle, and the tow processed smoothly and uniformly in subsequent high-speed operations. This performance contrasted markedly with the spreading, splitting and folding of tow, which led to an intolerable number of defects and interruptions, in attempts to process an untreated tow. Tows of nylon filaments ranging from approximately 4 denier per filament and 125,000 total denier to tows of 70 denier per filament and 400,000 total denier have responded equally well to the interlacing treatment.

A plurality of tows may be plied, fed to the process and interlaced into a single well-integrated tow. The process has capability for treating tows of other synthetic polymers, in addition to polyamides, such as polyesters, polyacrylics, polyolefins and others. The process may also be readily introduced at any stage of processing of tows in conjuction with conventional tow treatments such as stretching, drying, crimping and others.

I claim:

1. In the process of combining a large number of filaments into a tow for subsequent processing, the improvement for imparting coherence to the tow which comprises feeding the filaments as a bundle through a fluid zone, jetting into the fluid zone a plurality of high velocity fluid streams which include streams angled to exert a braking action on the forward travel of the bundle while maintaining the bundle open and streams directed tangentially against the traveling bundle for providing a torquing vortical whirling motion to the filaments to interentangle the filaments into a coherent tow, and withdrawing the tow from the fluid zone through a belt piddler to provide a tow having good interfilament cohesion.

2. A process as defined in claim 1 wherein said fluid is air.

3. A process as defined in claim 1 wherein the filaments are of a melt spun synthetic linear polymer and are combined into a tow soon after extrusion and solidification.

4. A process as defined in claim 1 wherein the belt piddler comprises coacting pressure rollers between which the filament bundle passes.

5. A process as defined in claim 1 wherein the filament denier is from 4 to 70.

6. A process as defined in claim 1 wherein the filament bundle has a total denier of 50,000 to about 800,000.

7. A process as defined in claim 1 wherein the tow has a total denier of 125,000 to 400,000.

8. In the process of combining a large number of filaments into a tow for subsequent processing, the improvement for imparting coherence to the tow which comprises feeding the filaments into a first fluid zone as a bundle traveling along an essentially linear path, forwarding the bundle through the fluid zone with a high velocity fluid stream directed so as to open the bundle and exert a torquing and forwarding action on the filaments, next passing the bundle through a confining zone to separate the opened bundle from said fluid zone, then passing the opened bundle through a second fluid zone, directing into the second zone a plurality of high velocity fluid streams which include streams angled to exert a braking action on the forward travel of the bundle while maintaining the bundle open and streams directed tangentially against the traveling bundle for providing a torquing vortical whirling motion to the filaments to interentangle the filaments into a coherent tow, the torquing actions in the first and second turbulent zones being in the same direction, and withdrawing the tow from said zone along an essentially linear path.

9. A process as defined in claim 8 wherein said filaments are fed at uniform speed to said first fluid zone and the tow is withdrawn from said second fluid zone at a uniform speed to provide essentially zero tension on the filaments in said zones.

10. A process as defined in claim 8 wherein treatment of said filament bundle takes place along an essentially straight path through said fluid zones.

11. A process as defined in claim 8 wherein the filament bundle is pulled into said first fluid zone by fluid exerting a pulling force of 2 to 3 pounds on the bundle.

12. A process as defined in claim 8 wherein said filament bundle is fed to said first fluid zone at a speed in excess of 1000 feet per minute.

13. A process as defined in claim 8 wherein said fluid is air.

14. Apparatus for treating a large bundle of filaments to form a coherent tow which comprises feed means for supplying a tow bundle of filaments at uniform speed, a first jet device for pulling the bundle from said feed means and for opening the bundle, an internal axial passage through said device for the bundle, a nozzle for jetting fluid into said passage in a spiralling path and directed to forward the bundle with a torquing action, a second jet device for maintaining the bundle open and interentangling the filaments to form a coherent tow, a treating chamber in said second device for the bundle, a fluid duct into said chamber for directing fluid against the direction of bundle movement to provide a turbulent braking action on the bundle, other fluid ducts into said chamber for directing fluid in a generally tangential direction to the path of the bundle to impart a vortical whirling motion in the same direction as the spiralling path of fluid in said first jet device, guiding means between said jet devices for confining lateral motion of the bundle during passage from the first jet device to the second jet device and for preventing interference by exhaust fluid from the jet devices, and takeup means comprising a belt piddler for withdrawing the bundle at uniform speed from the second jet device to provide a coherent tow of essentially straight configuration.

15. Apparatus as defined in claim 14 wherein the internal axial passage of said first jet device is a venturi-like passage formed by a section diverging in the direction of tow travel and located after said nozzle.

16. Apparatus as defined in claim 14 wherein said second jet device comprises a combination of a body member and a tubular shell for forming said treating chamber, an internal cavity in said body for supplying fluid, at least one fluid duct leading from said cavity and directed into the treating chamber at an angle of less than 60° with respect to the central longitudinal axis of the shell for jetting fluid into the treating chamber against the direction of movement of the filament bundle, and other fluid ducts in the body member leading from said cavity and directed into the treating chamber along planes perpendicular to the central axis of the shell toward a point between the central axis and the shell wall for jetting fluid to impart a vortical whirling motion.

* * * * *